US005851154A

United States Patent [19]

Moser et al.

[11] Patent Number: 5,851,154

[45] Date of Patent: Dec. 22, 1998

[54] PERFECTED AMUSEMENT RIDE

[76] Inventors: Alfeo Moser, Via Oberdan, 23; Claudio Soriani, Via Oderdan, 21, both of 45037 Melara, Italy

[21] Appl. No.: 562,447

[22] Filed: Nov. 24, 1995

[30] Foreign Application Priority Data

Nov. 29, 1994 [IT] Italy ..... B094A0529

[51] Int. Cl.[6] ..... A63G 1/24

[52] U.S. Cl. ..... 472/44; 472/47

[58] Field of Search ..... 472/44, 45, 46, 472/47, 39

[56] References Cited

U.S. PATENT DOCUMENTS 4,643,416 2/1987 van der Veen ..... 472/47 X 4,807,869 2/1989 Knijpstrer ..... 472/47 X 5,188,566 2/1993 Böme ..... 472/45

5,314,383 5/1994 Fabbri ..... 472/45

*Primary Examiner*—Kien T. Nguyen

*Attorney, Agent, or Firm*—Royston, Rayzor, Vickery, Novak & Druce

[57] ABSTRACT

An amusement ride resenting a platform; two vertical uprights extending upwards from the platforms; two arms fitted to respective uprights and rotated by a drive about a first horizontal axis; and a passenger car fitted to the arms, rotating about a second axis, and presenting two rows of seats, each defined by a seat portion and a backrest with a headrest; characterized in that the distance between the second axis and the headrests of the seats in the rear row is less than the distance between the second axis and the headrests of the seats in the front row.

16 Claims, 5 Drawing Sheets

PERFECTED AMUSEMENT RIDE

BACKGROUND OF THE INVENTION

The present invention relates to a perfected amusement ride featuring a passenger car with novel movements.

Patent EP 433557 relates to an amusement ride comprising:

a platform;

two vertical uprights fitted to the platform;

two arms, each fitted to a respective upright and formed in one piece, and both rotating about a horizontal axis; and a passenger car fitted to said arms.

The above arms rotate synchronously and parallel to each other, and, as they rotate, permit a complete turn of the car about its longitudinal axis; which complete turn of the car is effected only once for each turn of the arms, and only when the car is at its maximum height.

A second ride described in Patent EP 140238 comprises:

a platform;

two vertical uprights fitted to the platform;

two arms, each fitted to a respective upright and formed in two articulated parts, and both rotating about a horizontal axis; and a passenger car fitted to said arms.

The above arms rotate asynchronously, and, as they rotate, the part of the arm supporting the car rotates about its hinge axis, so that the distance between the parts of the two arms supporting the car remains constant. This provides for rotating the car fully about its longitudinal axis, but only about an axis inclined in relation to the rotation axis of the arms.

SUMMARY OF THE INVENTION

It is an object of the present invention to provide a perfected amusement ride with a different seat arrangement in relation to the rotation axis of the car, for better achieving full rotation of the car while at the same time ensuring the safety of the passengers.

It is a further object of the present invention to provide a perfected amusement ride capable of performing a number of complete turns of the car for each turn of the arms, and which provides for fully rotating the car about both a horizontal axis and an axis inclined in relation to the rotation axis of the arms.

According to the present invention, there is provided an amusement ride comprising:

a platform;

two parallel vertical uprights extending upwards from the platform;

two arms fitted to respective said uprights and rotated by drive means about a first horizontal axis; and a passenger car fitted to said arms, rotating about a second axis, and comprising a supporting structure, and two rows of seats facing crosswise to said second axis;

said seats each being defined by a seat portion and by a backrest with a headrest;

characterized in that, in a horizontal direction, the distance between said second axis and the headrests of the seats in the rear said row is less than the distance between said second axis and the headrests of the seats in the front said row.

According to the present invention, there is also provided an operating cycle for an amusement ride comprising:

a platform;

two parallel vertical uprights extending upwards from the platform;

two arms fitted to respective said uprights and rotated by drive means about a first horizontal axis;

a passenger car fitted by means of joints to said arms, and rotating about a second axis; and a brake device located at one of said joints, and in particular at a pin forming part of the joint and rotating about said second axis;

characterized in that it comprises, in succession:

synchronously rotating said arms parallel to each other and clockwise (anticlockwise) by approximately 10°–20° in relation to a vertical axis;

enabling said brake device to prevent rotation of said pin;

synchronously rotating said arms anticlockwise (clockwise) into a position substantially prior to that in which the car is at the maximum height;

reducing the anticlockwise (clockwise) rotation speed of said arms, and at the same time disabling said brake device so that, in said position, said pin, and hence the car, begins rotating about said second axis which, in this cycle, remains horizontal; and increasing the anticlockwise (clockwise) rotation speed of said arms, so that, substantially in said position, the car makes a complete turn anticlockwise (clockwise) about said second axis.

According to the present invention, there is also provided an operating cycle for an amusement ride comprising:

a platform;

two parallel vertical uprights extending upwards from the platform;

two arms fitted to respective said uprights and rotated by drive means about a first horizontal axis;

a passenger car fitted by means of joints to said arms, and rotating about a second axis;

each said arm comprising a respective first portion pivoting on the end of a respective said upright and which may therefore only be rotated about said first axis; and a respective second portion hinged to and rotating with the corresponding said first portion about said first axis, and which may also be rotated about its hinge axis by actuating means preferably comprising a respective hydraulic actuator; said car being fitted to the free ends of said second portions;

a brake device located at one of said joints, and in particular at a pin forming part of the joint and rotating about said second axis;

characterized in that it comprises, in succession:

enabling said brake device to prevent rotation of said pin;

asynchronously rotating said arms about said first axis;

rotating said second portions about their respective hinge axes, so that, as the arms are rotated asynchronously, the distance between the ends of said second portions supporting the car is maintained constant;

reducing the rotation speed of said arms, and at the same time disabling said brake device, so that said pin, and hence the car, begins rotating about said second axis, which, in this cycle, is inclined in relation to said first axis; and increasing the rotation speed of said arms, so that the car makes a complete turn about said second axis.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
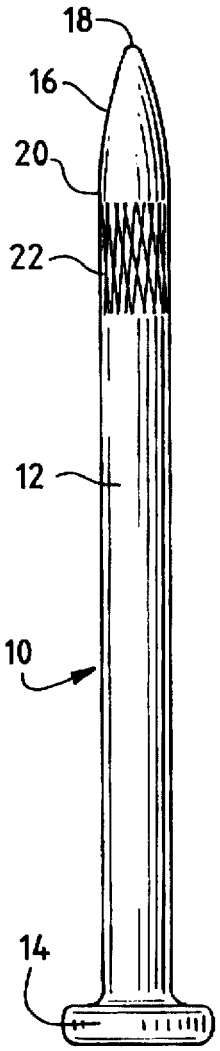
FIG. 1 shows a side view of an amusement ride in accordance with the teachings of the present invention.

Number 1 in FIG. 1 indicates an amusement ride comprising a platform 2 secured to the ground by a number of ties 3; and two parallel vertical uprights 4, 5 extending upwards from opposite axial ends of platform 2. More specifically, ties 3 secure platform 2 by connecting uprights 4 and 5 to the ground; and platform 2 may present a number of wheels for transporting ride 1.

As shown in FIG. 1, uprights 4 and 5 are fitted at the top end with respective arms 7 and 8 rotated by respective known drive means 11 about a horizontal axis 12. Each arm 7, 8 comprises a respective portion 7*a*, 8*a* pivoting on the top end of respective upright 4, 5 and which may therefore only rotate about axis 12; and a respective portion 7*b*, 8*b* hinged to and rotatable with respective portion 7*a*, 8*a* about axis 12, and which may be rotated about its hinge axis 13 by a respective hydraulic actuator 14 fitted to portion 7*a*, 8*a* and presenting a sliding rod hinged at one end to portion 7*b*, 8*b*.

Figure 2:
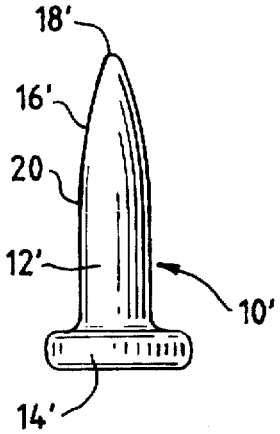
FIG. 2 shows a larger-scale section of an articulated joint on the FIG. 1 ride.
Figure 3:
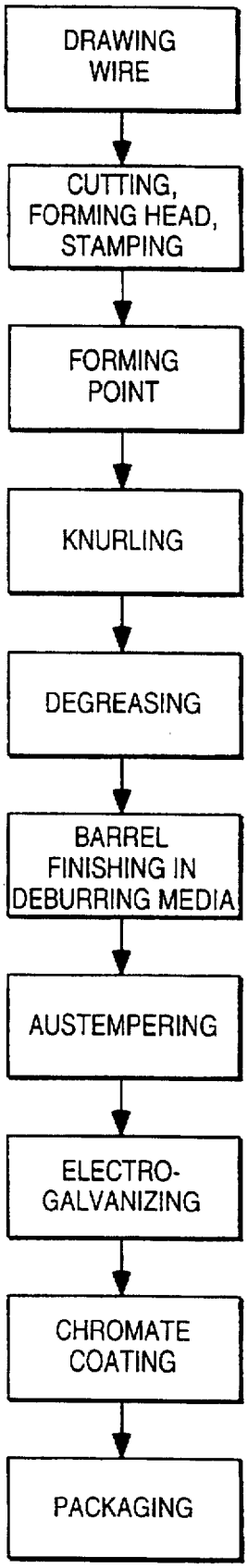
FIG. 3 shows a side view of a passenger car of the FIG. 1 ride.

As shown in FIGS. 1 and 3, ride 1 comprises a passenger car 15 presenting a supporting structure 16, and two rows 17 of seats fitted to structure 16. Car 15 is fitted to arms 7 and 8, and in particular to portions 7*b* and 8*b*. More specifically, along axis 18, structure 16 presents two articulated joints 21 (FIG. 2) by which it is connected to the free ends of portions 7*b* and 8*b*, and by which it is permitted to rotate about axis 18 during operation of ride 1.

As shown in FIG. 2, each joint 21 comprises a pin 22 of axis 18 and fitted to the free end of respective portion 7*b*, 8*b*; via the interposition of bearings 23, a portion 22*a* of pin 22 is housed inside a seat 24 formed in respective portion 7*b*, 8*b*, so that pin 22 is free to rotate about axis 18; a portion 22*b* of pin 22, outside seat 24, presents a through hole 25 formed along an axis 26 perpendicular to axis 18, and housing, via the interposition of bushes 27, a pin 28 which is free to rotate about axis 26; and the two axial ends of pin 28, outside hole 25, are mechanically integral with respective plates 31 in turn welded integral with a plate 32.

As shown in FIG. 2, plate 32 is fitted integral with a pin 33 extending along an axis 34 perpendicular to the plane containing axes 18 and 26; pin 33 is housed inside a hollow cylinder 35 fitted to an axial end of structure 16 of car 15; and each joint 21 therefore permits three degrees of freedom of car 15: rotation about axis 34, rotation about axis 26, and rotation about axis 18. The joint 21 between portion 7*b* of arm 7 and the corresponding axial end of car 15 presents a known brake device 36, such as an Eaton Airflex 325DC Clutch, fitted to portion 22*c* of pin 22 outside seat 24.

As shown in FIG. 1, ride 1 also comprises an electronic control unit 37 for controlling drive means 11, actuators 14 and device 36, and to which are connected known sensors 39 for detecting the angle of rotation of arms 7 and 8 about axis 12 and of car 15 about axis 18.

As shown in FIG. 3, both rows 17 of seats face in the same horizontal direction crosswise to axis 18, and are fitted to the same deck 38 of structure 16; which deck 38 presents a single flat surface 38*a* fitted with rows 17, and a front surface 38*b* at a lower level than surface 38*a* and for supporting the feet of the passengers in front row 17. The seat portions 17*a* of the seats in front row 17 are lower than those of the seats in rear row 17; the backrests 17*b* of rows 17 are substantially perpendicular to surface 38*a*; the distance D1 between the headrest of the seats in rear row 17 and a straight vertical line 19 through axis 18 is less than the distance D2 between line 19 and the headrest of the seats in front row 17; and axis 18 is substantially on a level with the seat portions 17*a* of rear row 17, and close to the barycenter B of car 15, which barycenter B preferably lies along line 19.

In actual use, ride 1 provides for a number of operating cycles, a first of which is shown in FIGS. 4 to 9, and in which the two portions of arms 7 and 8 remain coaxial, i.e. actuators 14 are not operated.

Figure 4:
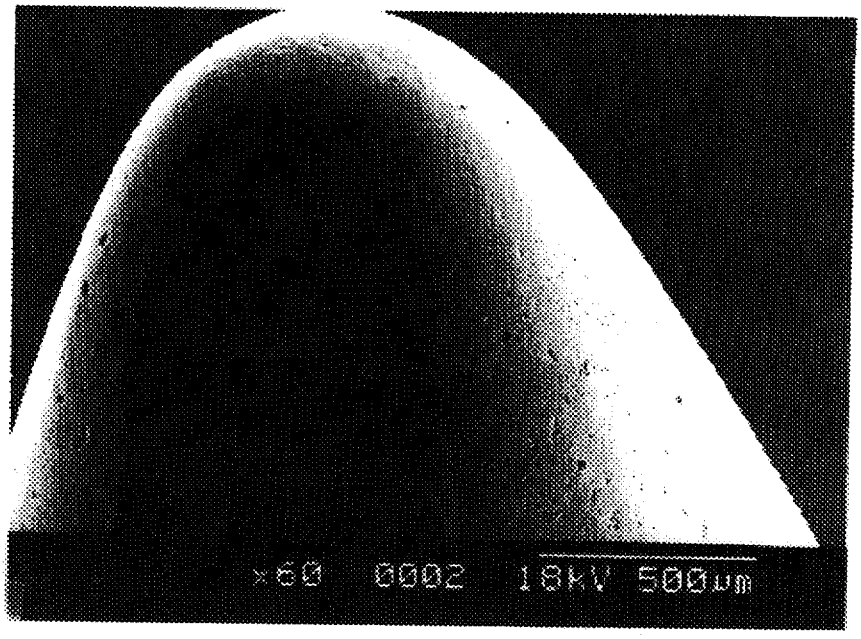
FIGS. 4 to 9 show schematic views, in succession, of a first operating cycle of the FIG. 1 ride.
Figure 5:
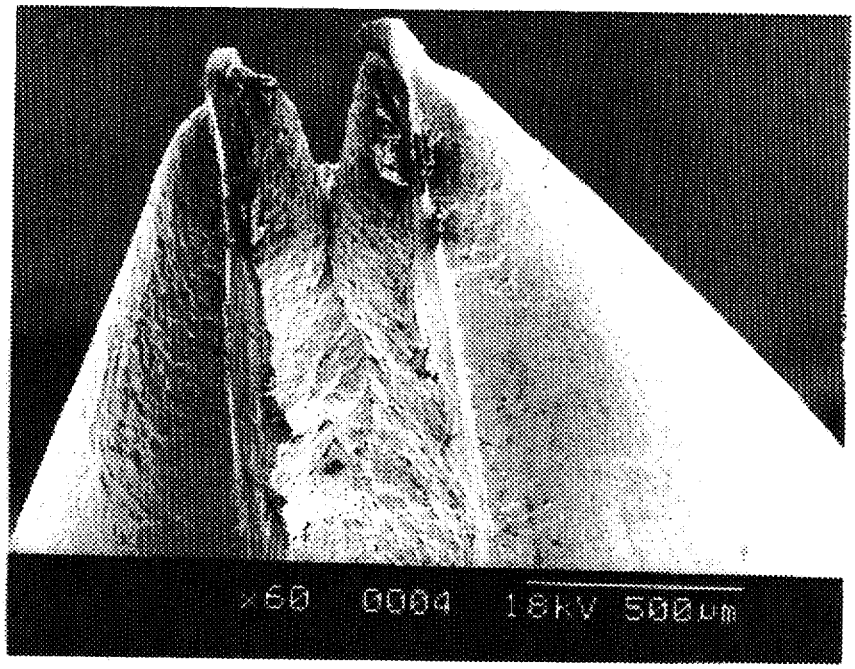
Fig. 5 Prior Art

Commencing from the position shown in FIG. 4, the operating cycle in FIGS. 4 to 9 provides for synchronously rotating arms 7 and 8 parallel to each other and clockwise (in the drawings) by approximately 10°–20° into the angular position shown in FIG. 5. As of this position, brake device 36 is first enabled to prevent rotation of pin 22, and arms 7 and 8 are then rotated synchronously anticlockwise and preferably at constant speed into the FIG. 6 position in which the longitudinal axes of arms 7 and 8 are roughly perpendicular to the vertical. In the FIG. 6 position, car 15 is set to a dead center position, so that, if brake device 36 were to be disabled, car 15 could rotate either way about axis 18.

Figure 6:
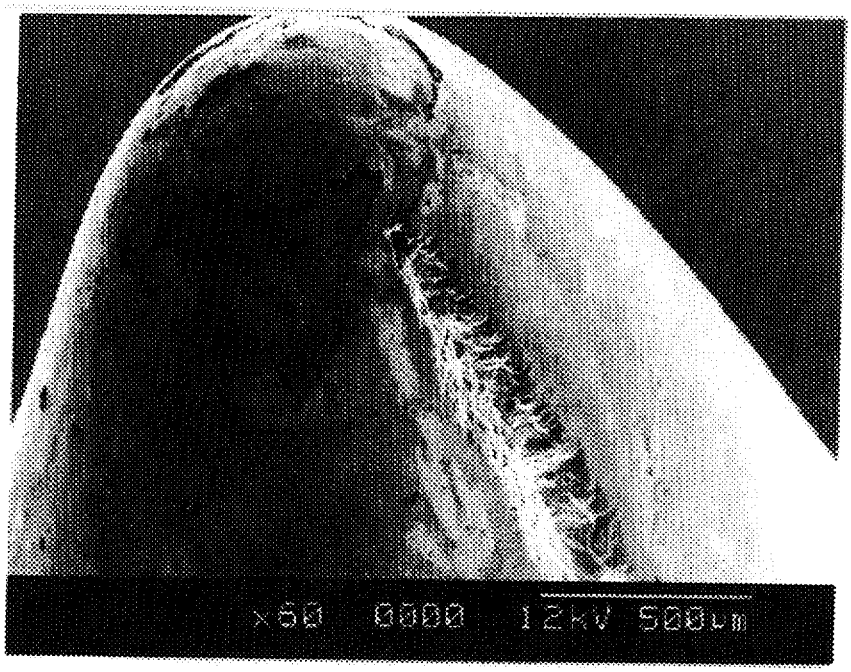
Figure 7:
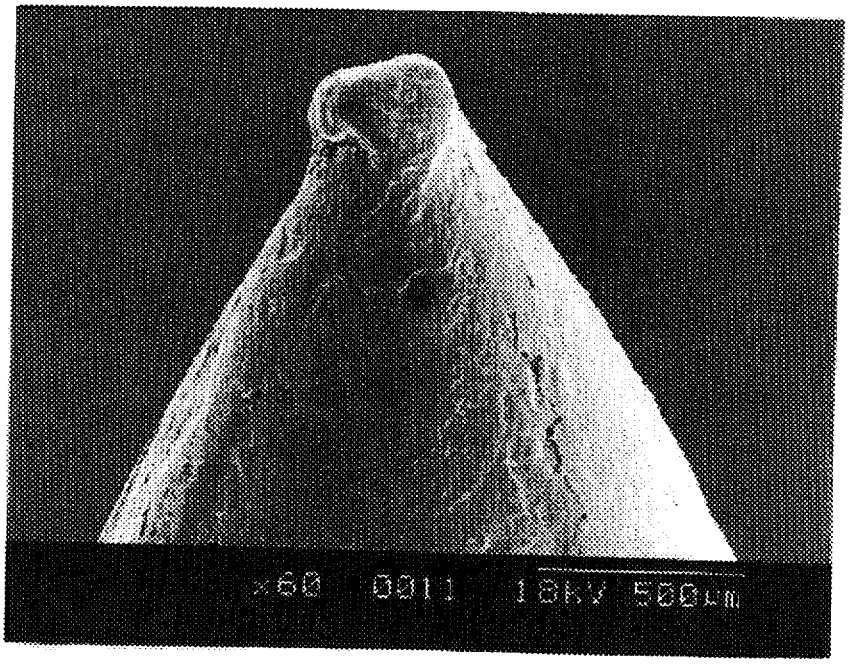
Fig. 7 Prior Art
Figure 8:
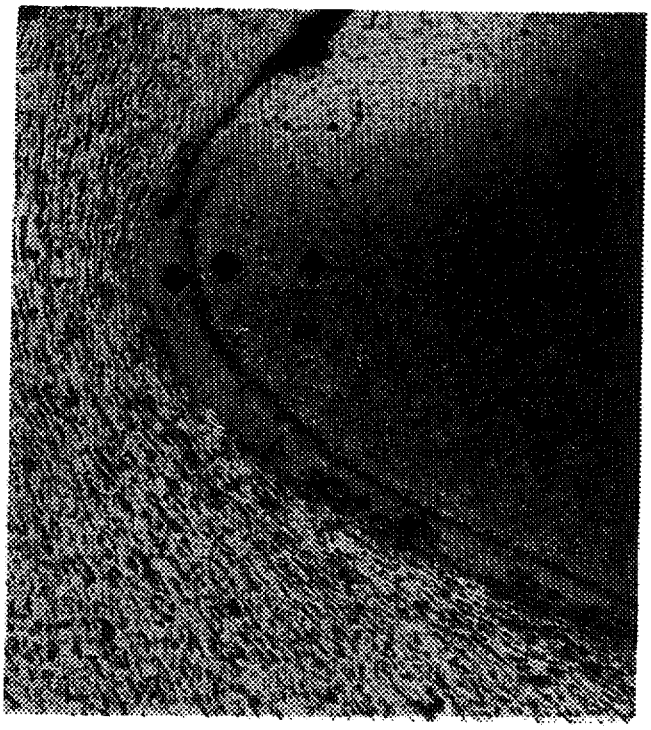
Figure 9:
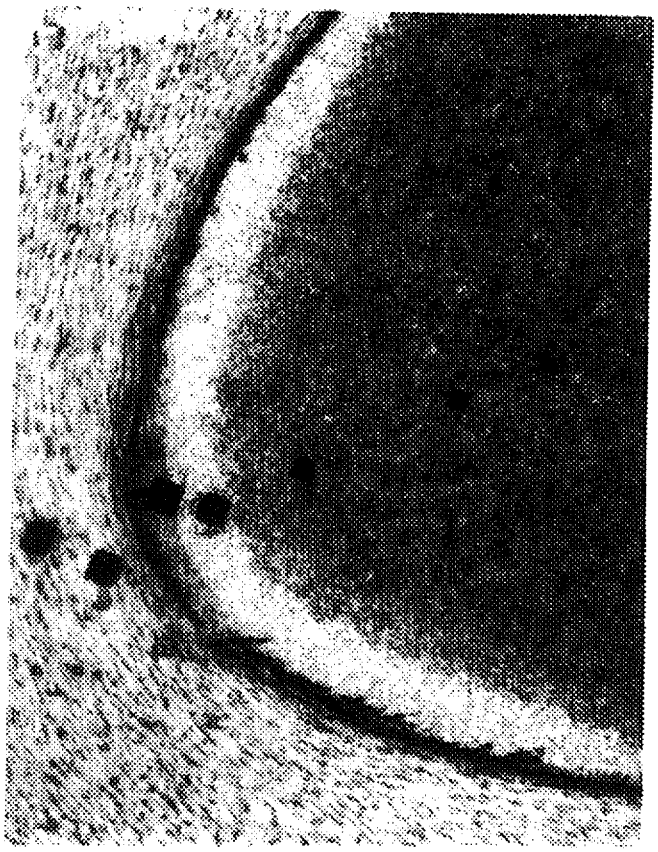
Fig. 9 Prior Art

As of the FIG. 6 position, the rotation speed of arms 7 and 8 is reduced, and, at the same time, brake device 36 is disabled to permit pin 22 to rotate about axis 18, as a consequence of which two operations, car 15 begins rotating anticlockwise about axis 18 which, in this cycle, remains horizontal. The rotation speed of arms 7 and 8 is then increased to overcome the dead center position and make a full turn of the car anticlockwise about axis 18, as shown in FIGS. 7, 8 and 9. For each complete turn of arms 7 and 8, car 15 may make one or a number of complete turns. In the first case, arms 7 and 8 are rotated at constant speed, and brake device 36 is enabled when arms 7 and 8 reach the start position shown in FIG. 4. In the second case, the successive operations governing each complete turn of car 15 are repeated: brake device 36 is enabled, the rotation speed of arms 7 and 8 is reduced and brake device 36 simultaneously disabled, and the rotation speed of arms 7 and 8 is increased.

Figure 10:
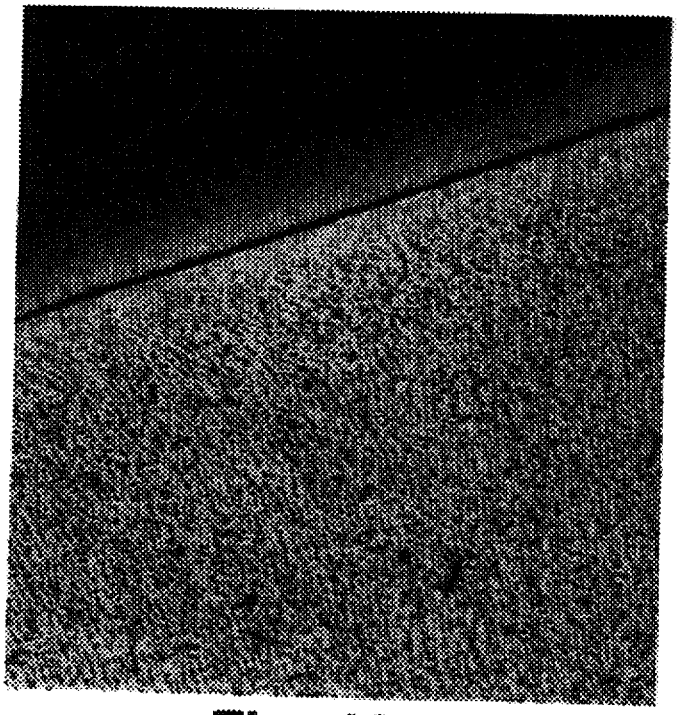
FIGS. 10 to 12 show schematic views, in succession, of a second operating cycle of the FIG. 1 ride.
Figure 11:
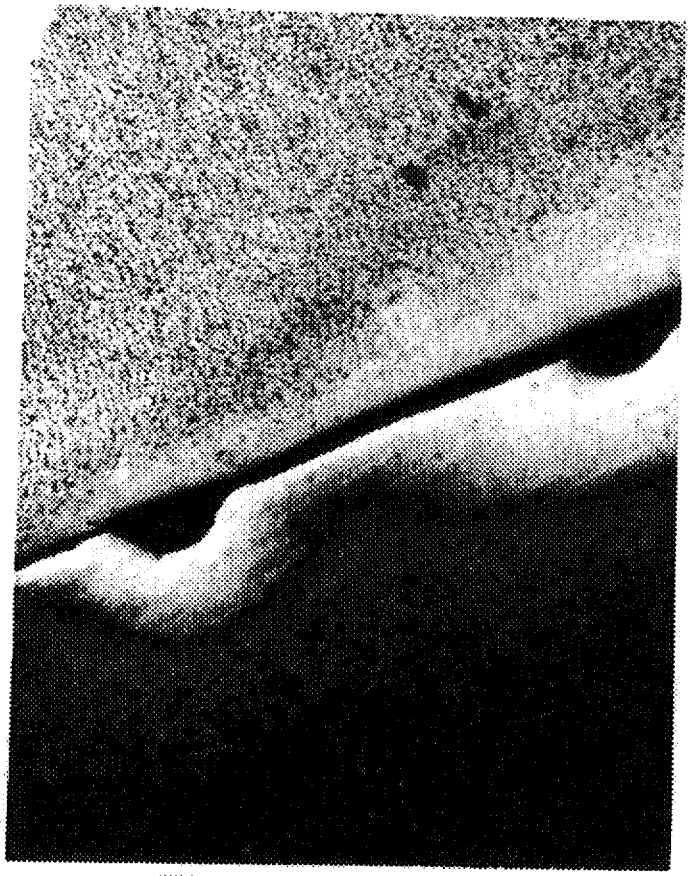
Fig. 11 Prior Art
Figure 1:
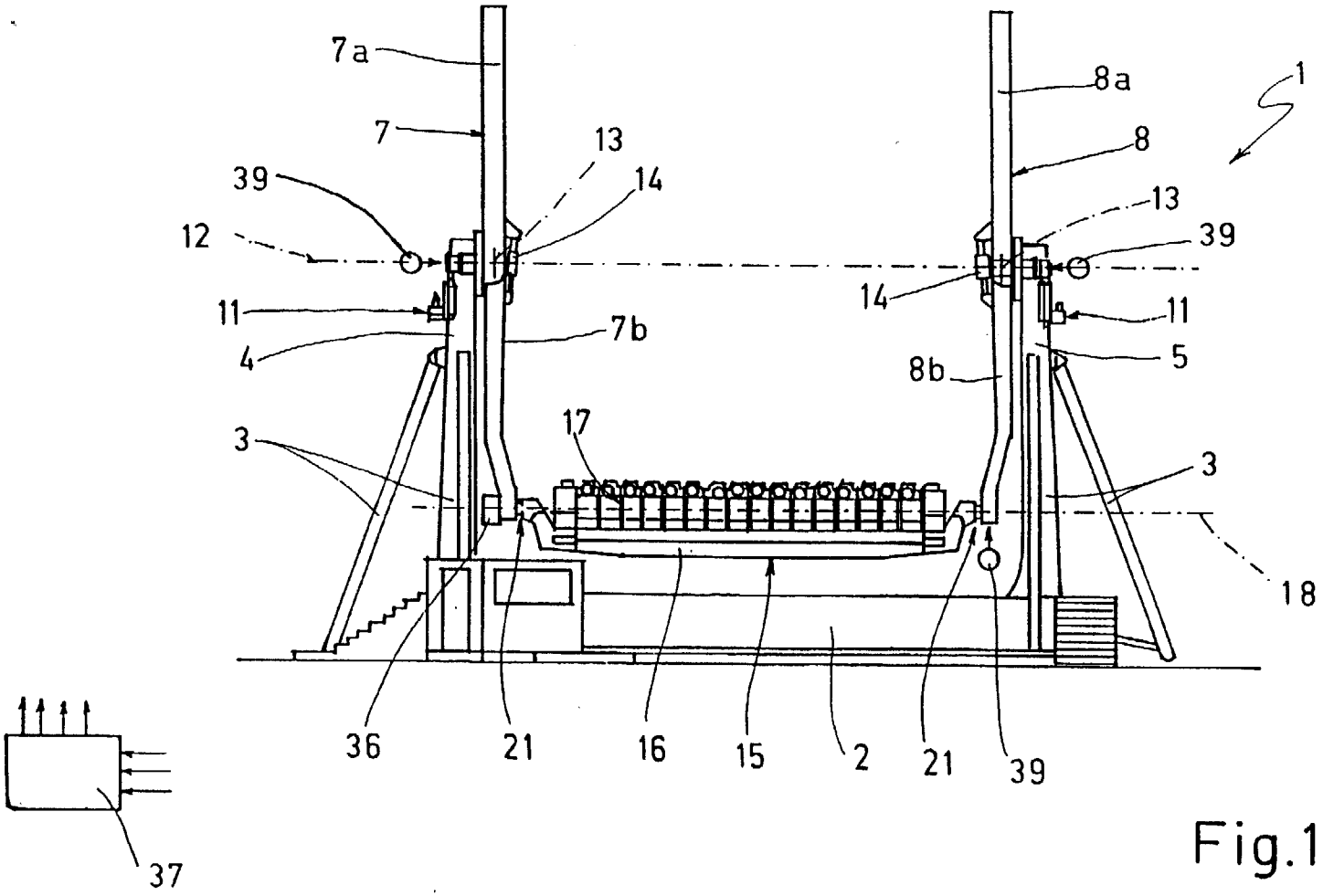
Figure 2:
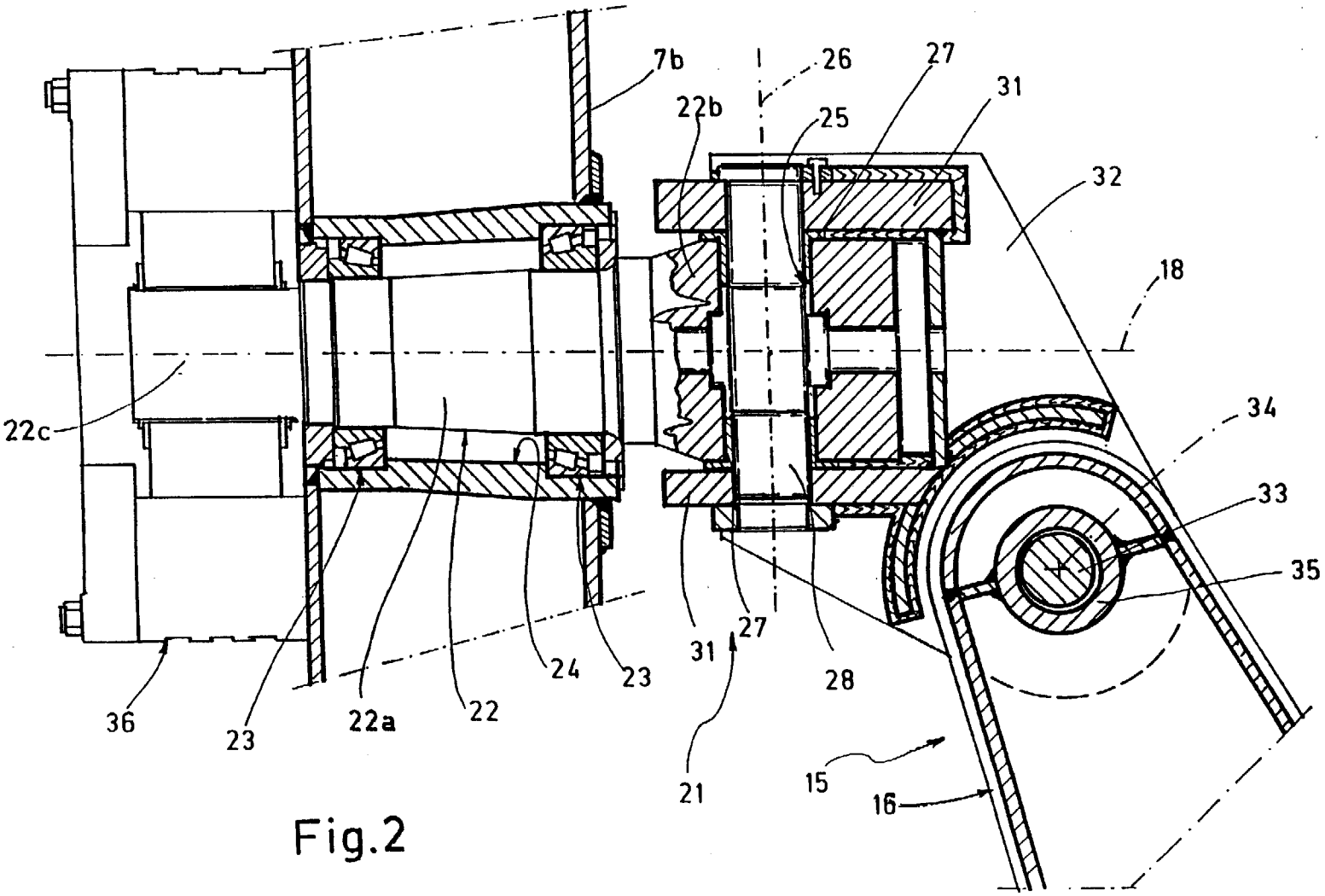
Figure 3:
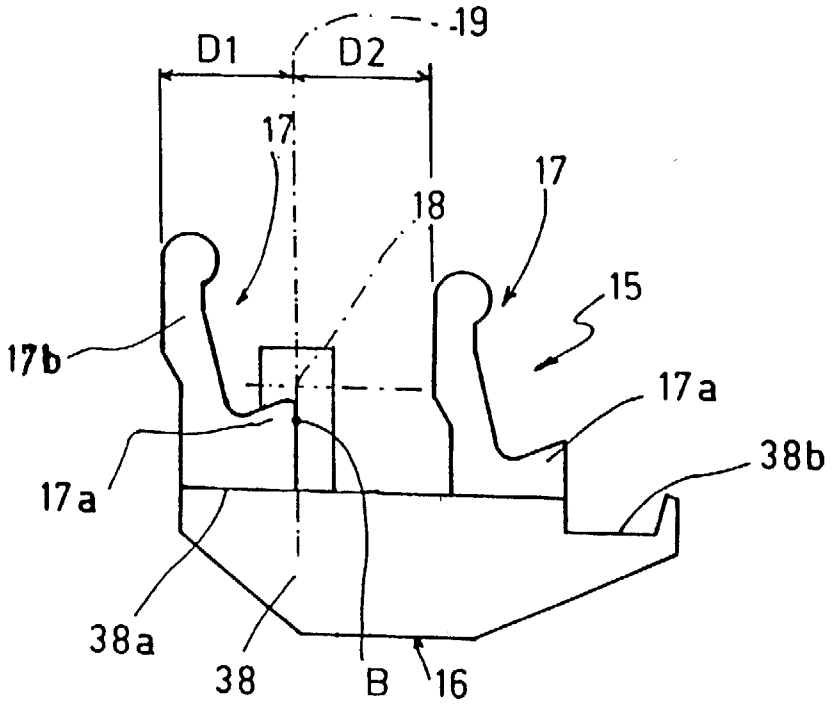
Figure 4:
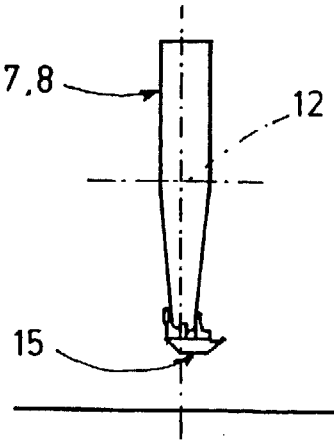
Figure 5:
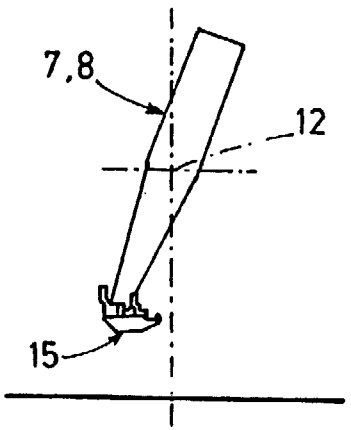
Figure 6:
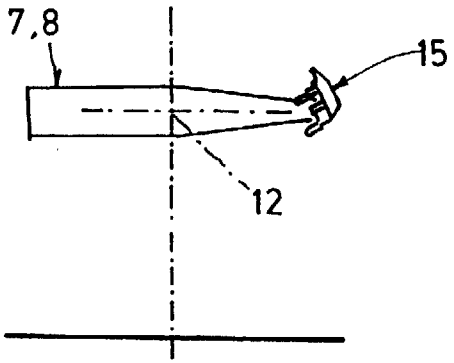
Figure 7:
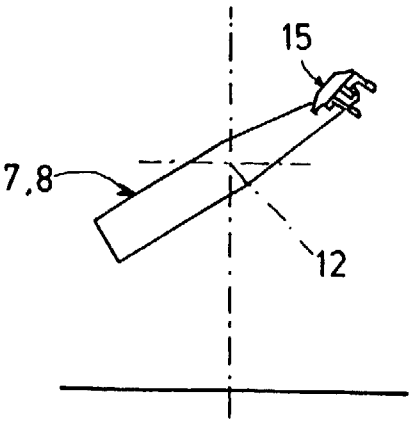
Figure 8:
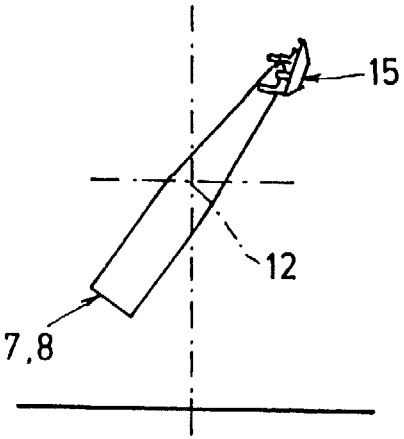
Figure 9:
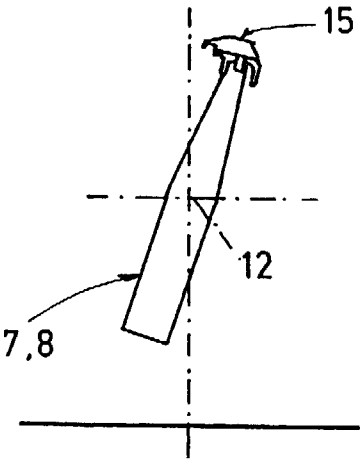
Figures 10, 11, 12:
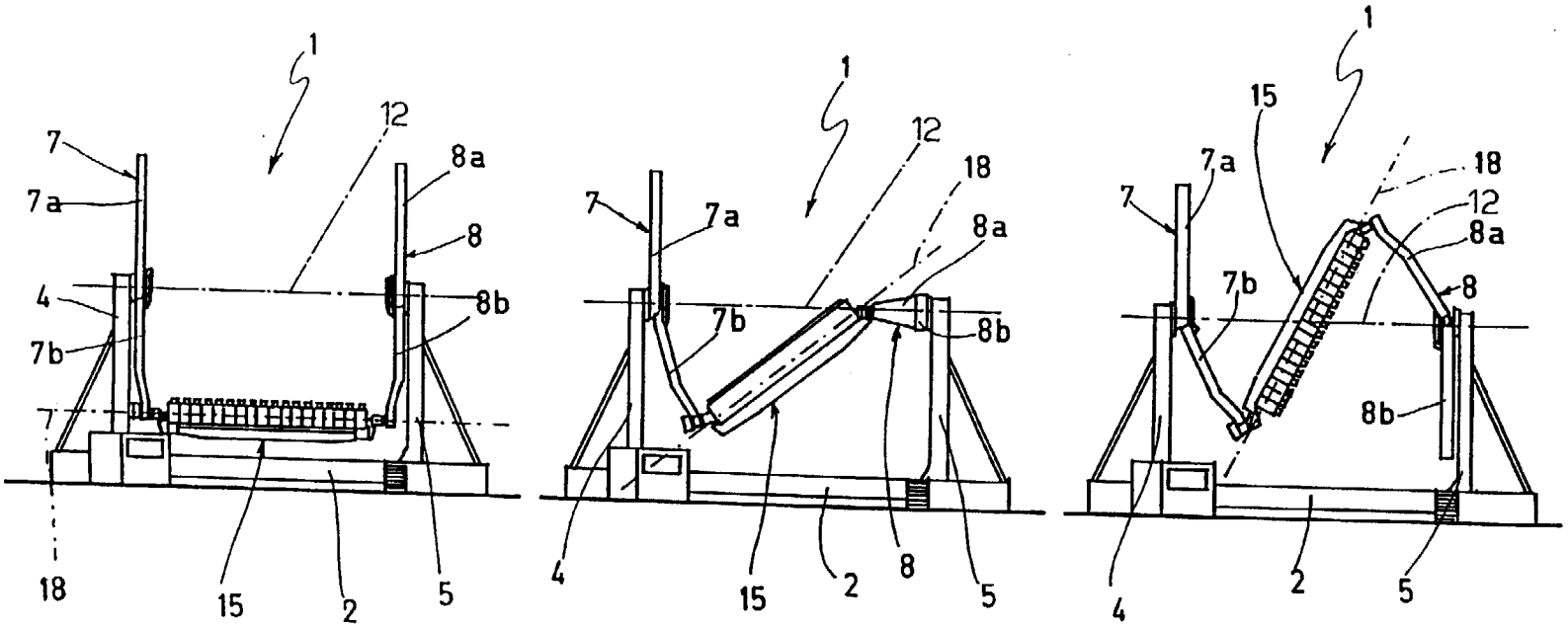

A second operating cycle, shown in FIGS. 10 to 12, provides successively for:

- asynchronously rotating arms 7 and 8 about axis 12;
- rotating portions 7*b* and 8*b*, by means of actuators 14, about their respective hinge axes 13, so that, as arms 7 and 8 are rotated asynchronously, the distance between the ends of portions 7*b* and 8*b* supporting car 15 remains constant; and
- fully rotating car 15 about axis 18 (which, in this case, is inclined in relation to axis 12) by means of a series of successive operations which, for each complete turn of car 15, comprises: enabling brake device 36, reducing the rotation speed of arms 7 and 8 and simultaneously disabling brake device 36, and increasing the rotation speed of arms 7 and 8.

The operating cycles of ride 1 are controlled by unit 37 which, by means of sensors 39, knows the angular position of both arms 7 and 8 and of car 15 at all times. Ride 1 may of course also perform more complex operating cycles, e.g. comprising steps of both the above cycles.

The advantages of the present invention will be clear from the foregoing description.

In particular, it provides for a ride capable of performing a number of different operating cycles, mainly due to providing joints 21 permitting three degrees of freedom of car 15. A further point to note is the advantageous position of axis 18 in relation to the component parts of car 15, which, by virtue of axis 18 being located, along line 19, close to the barycenter B (FIG. 3) of the car, is rotated fully with very little effort.

Clearly, changes may be made to ride 1 as described and illustrated herein without, however, departing from the scope of the present invention.

In particular, the arrangement of the seats in rows 17 of car 15 may be other than as shown, e.g. the seats may be inclined, providing axis 18 remains closer to the rear row than the front. In the case of synchronous rotation of arms 7 and 8 as shown in FIG. 6, the position in which car 15 begins rotating about axis 18 may vary within a wide angular range, preferably of up to about 10°–20° prior to the maximum height position of car 15.

We claim:

1. An amusement ride, comprising:

two upwardly extending and substantially parallel vertical uprights;

two arms fitted to respective said uprights;

drives for rotating said arms about a first horizontal axis;

a passenger car axially attached to free ends of said arms and rotatable about a second axis extending between said arms in the axis of attachment of said car to said arms;

wherein said car comprises:

a supporting structure; and a front and a rear row of seats facing crosswise to said second axis, wherein each said row comprises a seat portion having a backrest with a headrest; and wherein the radial distance between said second axis and the headrests of the seats of said rear row is less than the radial distance between said second axis and the headrests of the seats of said front row.

2. A ride as claimed in claim 1, wherein said second axis is close to the barycenter of said car.

3. A ride as claimed in claim 2, wherein said barycenter lies along a straight line perpendicular to said second axis.

4. A ride as claimed in claim 2, characterized in that said second axis (18) is substantially on a level with the seat portions of said seats in said rear row.

5. A ride as claimed in claim 1, wherein said supporting structure comprises a deck presenting a flat surface to which both said rows of seats are fitted.

6. A ride as claimed in claim 5, wherein said seat portions of the seats in said front row are lower than those of the seats in said rear row.

7. A ride as claimed in claim 1, further comprising a control for controlling complete rotation of said car about said second axis.

8. A ride as claimed in claim 7, wherein:

each of said arms comprises:

a first portion pivotable relative to a respective said upright and rotatable only about said first axis; and a second portion hinged to and rotatable with the corresponding said first portion about said first axis and which is also rotatable about the hinge axis between said first portion and said second portion by an actuator; and said car is fitted to the free ends of said second portions.

9. An amusement ride, comprising:

two upwardly extending and substantially parallel vertical uprights extending upwards from the platform;

two arms fitted to respective said uprights;

drives for rotating said arms about a first horizontal axis;

a passenger car axially attached to free ends of said arms and rotatable about a second axis extending between said arms in the axis of attachment of said car to said arms;

wherein said car comprises:

a supporting structure; and a front and a rear row of seats facing crosswise to said second axis, wherein each said row comprises a seat portion having a backrest with a headrest;

wherein the radial distance between said second axis and the headrests of the seats of said rear row is less than the radial distance between said second axis and the headrests of the seats of said front row;

a control for controlling complete rotation of said car about said second axis;

wherein each of said arms comprises:

a first portion pivotable relative to a respective said upright and rotatable only about said first axis; and a second portion hinged to and rotatable with the corresponding said first portion about said first axis, and which is also rotatable about the hinge axis between said first portion and said second portion by an actuator;

wherein said car is fitted to the free ends of said second portions;

a plurality of articulating joints interposed between the axial ends of said car and the free ends of said second portions of said arms;

wherein each said articulating joint comprises:

a first pin fitted along said second axis to the free end of the second portion of the respective said arm and rotatable about said second axis;

a first portion of said first pin housed, via the interposition of bearings, inside a first seat formed in the second portion of the respective said arm;

a second portion of said first pin outside said first seat;

a through hole formed in said second portion of said first pin and along a third axis perpendicular to said second axis;

a second pin housed inside said through hole and free to rotate about said third axis;

a body mechanically integral with said second pin;

a third pin fitted to said body and extending along a fourth axis perpendicular to the plane containing said second and third axes and rotatable about said fourth axis; and a second seat formed at the axial end of said car and housing said third pin; and wherein each of said articulating joints is adapted to permit freedom of rotation of said car about said second, third and fourth axes.

10. A ride as claimed in claim 9, wherein said control comprises a brake fitted to one of said articulating joints.

11. A ride as claimed in claim 10, wherein said control comprises:

an electronic control unit for controlling said drive, said actuator, and said brake; and sensors connected to said control unit for determining the angular position of said arms about said first axis and of said car about said second axis.

12. A method of operation of an amusement ride, comprising the steps of:

providing: (a) two upwardly extending and substantially parallel vertical uprights, (b) two arms fitted to respective said uprights, (c) drives for rotating said arms about a first horizontal axis, (d) a passenger car axially attached near said car's barycenter by articulating joints to said arms and rotatable about a second axis extending between said arms in the axis of attachment of said car to said arms, and (e) a brake located at one of said articulating joints;

rotating each said arm substantially parallel to, and substantially synchronously with, the other said arm and by approximately 10–20 DEGREE in a first direction relative to a vertical axis;

enabling said brake to prevent rotation of said car about said second axis;

rotating said arms in a second direction opposite said first direction and into a brake disabling position substantially prior to that in which said car is at a maximum height;

reducing the rotation speed in said second direction of said arms;

disabling said brake to allow said car to rotate about said second axis; and increasing the rotation speed in said second direction of said arms to assist said car in making a complete turn, in a direction the same as said second direction, about said second axis.

13. A method for operation of an amusement ride as claimed in claim 12, wherein said brake disabling position falls within an angular range of up to 10–20 DEGREE prior to the maximum height position of said car.

14. A method for operation of an amusement ride as claimed in claim 12, wherein for each complete rotation about said first axis of said arms said car makes a plurality of complete rotations about said second axis.

15. A method for operation of an amusement ride, comprising the steps of:

providing (a) two upwardly extending and substantially parallel vertical uprights, (b) two arms, each having a first portion and a second portion, fitted to respective said uprights, (c) drives for rotating said arms about a first horizontal axis, (d) a passenger car axially attached near said car's barycenter by articulating joints to said arms and rotatable about a second axis extending between said arms in the axis of attachment of said car to said arms, (e) wherein each said first portion of each said arm is pivotable relative to a respective said upright and rotatable only about said first axis (f) wherein each said second portion of each said arm is hinged to and rotatable with the corresponding said first portion about said first axis, and which is also rotatable about the hinge axis between said first portion and said second portion by an actuator, (g) wherein said car is fitted to the free ends of said second portions, and (h) a brake located at one of said articulating joints;

enabling said brake to prevent rotation of said car about said second axis;

rotating said arms asynchronously about said first axis;

rotating each said second portion about the respective hinge between said first portion and said second portion so as to maintain substantially constant distance between the free ends of said second portions;

reducing the rotation speed of said arms;

disabling said brake to allow said car to rotate about said second axis; and increasing the rotation speed of said arms to assist said car in making a complete turn about said second axis.

16. A method for operation of an amusement ride as claimed in claim 15, wherein for each complete rotation about said first axis of said arms said car makes a plurality of complete rotations about said second axis.

* * * * *

UNITED STATES PATENT AND TRADEMARK OFFICE

CERTIFICATE OF CORRECTION

PATENT NO. : 5,851,154
DATED : December 22, 1998
INVENTOR(S) : Alfeo Moser, et al.

It is certified that error appears in the above-identified patent and that said Letters Patent is hereby corrected as shown below:

The title page showing the illustrative figure should be deleted to be replaced with the attached title page.

Drawing sheets, consisting of Figs. 1-5, should be deleted to be replaced with the Drawing Sheets, consisting of Figs. 1-5, as shown on the attached page.

Signed and Sealed this

Twenty-ninth Day of August, 2000

*Attest:*

Q. TODD DICKINSON

*Attesting Officer*

*Director of Patents and Trademarks*

United States Patent [19]

Moser et al.

[11] Patent Number: 5,851,154

[45] Date of Patent: Dec. 22, 1998

[54] PERFECTED AMUSEMENT RIDE

[76] Inventors: Alfeo Moser, Via Oberdan, 23; Claudio Soriani, Via Oderdan, 21, both of 45037 Melara, Italy

[21] Appl. No.: 562,447

[22] Filed: Nov. 24, 1995

[30] Foreign Application Priority Data

Nov. 29, 1994 [IT] Italy ..... B094A0529

[51] Int. Cl.[6] ..... A63G 1/24

[52] U.S. Cl. ..... 472/44; 472/47

[58] Field of Search ..... 472/44, 45, 46, 472/47, 39

[56] References Cited

U.S. PATENT DOCUMENTS 4,643,416 2/1987 van der Veen ..... 472/47 X 4,807,869 2/1989 Knijpstrer ..... 472/47 X 5,188,566 2/1993 Böme ..... 472/45

5,314,383 5/1994 Fabbri ..... 472/45

*Primary Examiner*—Kien T. Nguyen

*Attorney, Agent, or Firm*—Royston, Rayzor, Vickery, Novak & Druce

[57] ABSTRACT

An amusement ride resenting a platform; two vertical uprights extending upwards from the platforms; two arms fitted to respective uprights and rotated by a drive about a first horizontal axis; and a passenger car fitted to the arms, rotating about a second axis, and presenting two rows of seats, each defined by a seat portion and a backrest with a headrest; characterized in that the distance between the second axis and the headrests of the seats in the rear row is less than the distance between the second axis and the headrests of the seats in the front row.

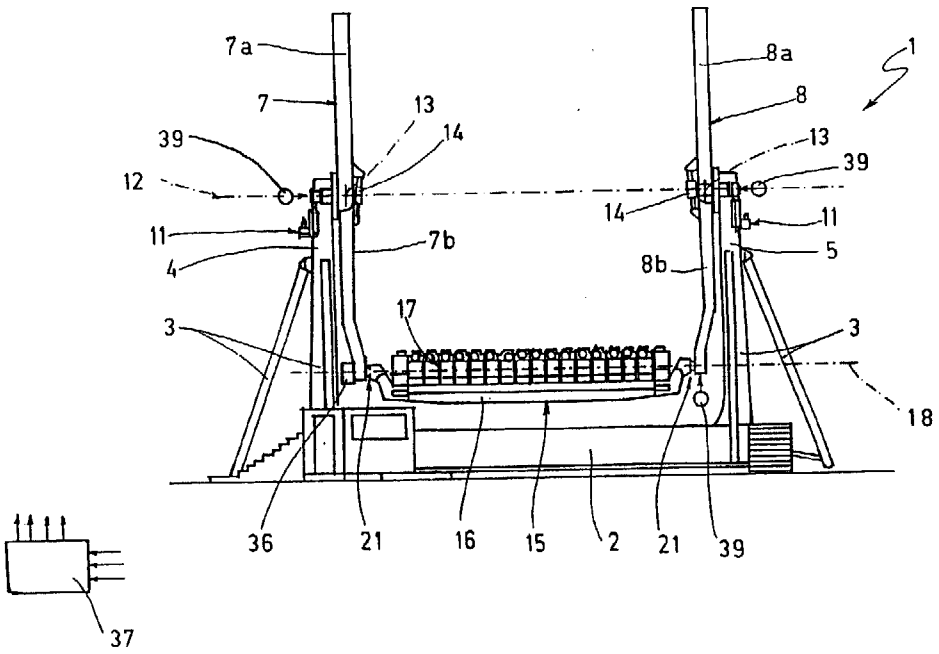

16 Claims, 5 Drawing Sheets